US005622676A

United States Patent [19]

Lind

[11] Patent Number: 5,622,676

[45] Date of Patent: Apr. 22, 1997

[54] PIPETTE TIP RACK

[75] Inventor: Peter M. Lind, Yountville, Calif.

[73] Assignee: LABCON, North America, San Rafael, Calif.

[21] Appl. No.: 619,121

[22] Filed: Mar. 20, 1996

Related U.S. Application Data

[63] Continuation of Ser. No. 377,161, Jan. 24, 1995, abandoned, which is a continuation-in-part of Ser. No. 253,977, Jun. 3, 1994, Pat. No. 5,470,538.

[51] Int. Cl.[6] ..... B01L 3/02; B65D 85/00

[52] U.S. Cl. ..... 422/104; 422/100; 206/443; 211/194

[58] Field of Search ..... 422/99, 100, 103, 422/104; 436/809; 206/443; 211/72, 74, 76, 188, 194

[56] References Cited

U.S. PATENT DOCUMENTS

| | | | |
|---|---|---|---|
| 3,853,217 | 12/1974 | Scordato et al. | 206/223 |
| 4,130,978 | 12/1978 | Cohen | 53/444 |
| 4,349,109 | 9/1982 | Scordato et al. | 206/562 |
| 4,413,731 | 11/1983 | Weideman | 206/379 |
| 4,577,760 | 3/1986 | Rainin et al. | 206/508 |
| 5,039,493 | 8/1991 | Oprandy | 422/101 |
| 5,057,282 | 10/1991 | Linder | 422/104 |
| 5,232,669 | 8/1993 | Pardinas | 422/100 |
| 5,318,753 | 6/1994 | Honda | 422/104 |
| 5,324,482 | 6/1994 | Scaramella et al. | 422/100 |
| 5,366,088 | 11/1994 | Hill et al. | 206/499 |
| 5,392,914 | 2/1995 | Lemieux et al. | 206/499 |

*Primary Examiner*—Long V. Le
*Attorney, Agent, or Firm*—Phillips, Moore, Lempio & Finley

[57] ABSTRACT

A pipette tip rack loader is disclosed that will load a flat of pipette tips into a rack for use on a laboratory bench. The flat for the pipette tips is substantially the same dimensions as the top surface of the tip rack to be loaded, and has an identical hole pattern so that the ends of the tips loaded in the flat can be positioned one-to-one in the holes of the tip rack. The loader consists of an upper platform that holds the flat and a lower platform or base that holds the unloaded tip rack. The upper platform is biased in a first position sufficiently high enough above the tip rack that the tips do not hit the rack. The upper platform can be depressed so that the tips in the flat thread into the tip rack holes. As the upper platform nears the tip rack, the flat is released from the upper platform to rest on the tip rack with the tips registered in the rack. Several flats with tips may be positioned in the loader with tips in the upper flats. The loader operates such that only one flat is released at a time.

5 Claims, 8 Drawing Sheets

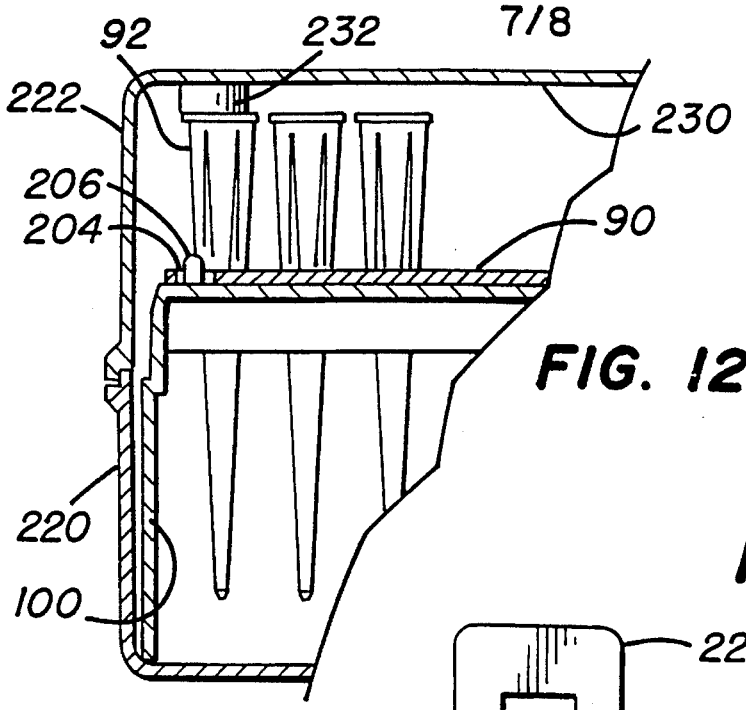
FIG. 12
FIG. 11
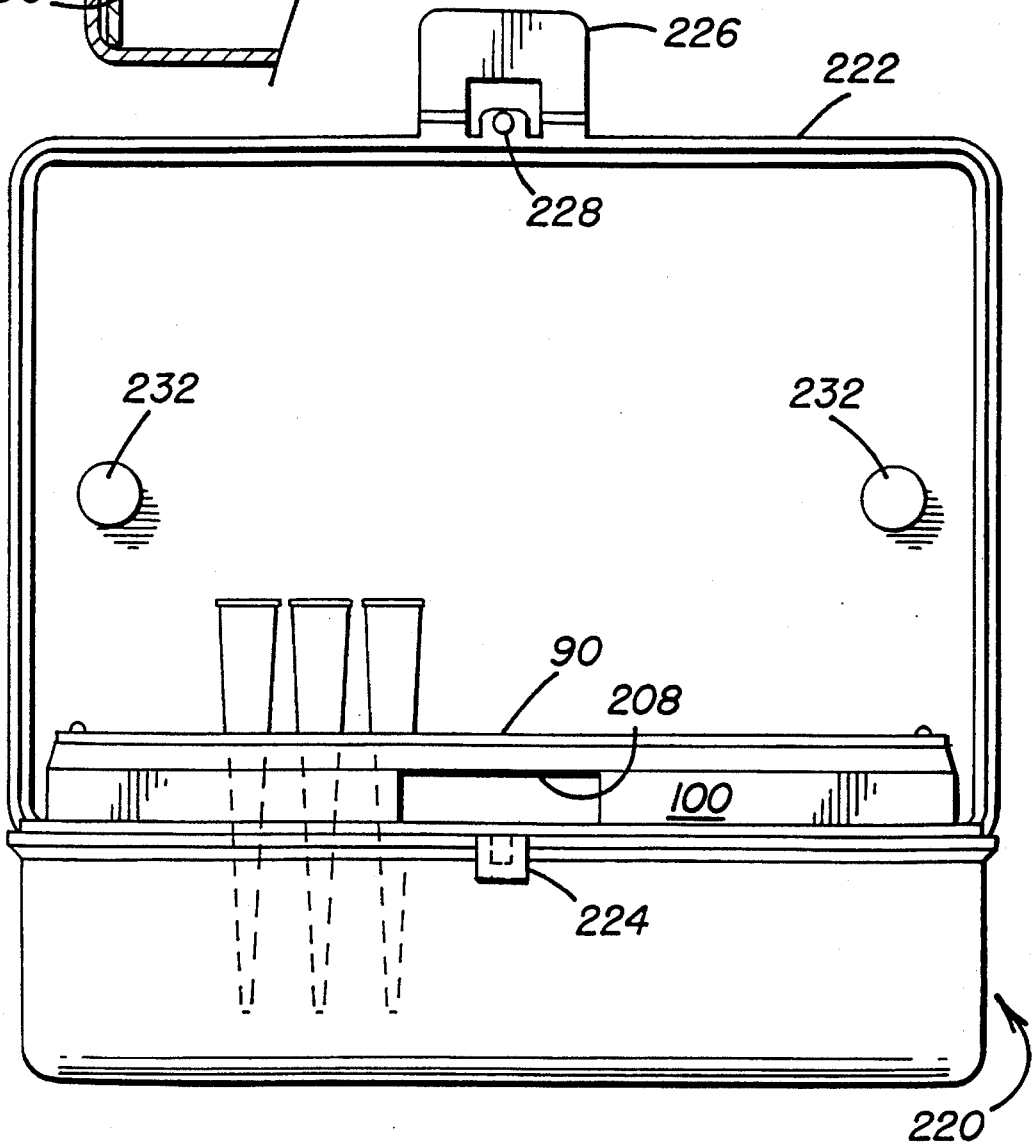

PIPETTE TIP RACK

This is a continuation of application of Ser. No. 08/377,161 filed on Jan. 24, 1995, now abandoned which is a continuation-in-part of application Ser. No. 08/253,977 filed on Jun. 3, 1994, now U.S. Pat. No. 5,470,538, issued Nov. 28, 1995.

BACKGROUND OF THE INVENTION

The invention relates to a device for loading pipette tips that have been positioned in a flat into an upstanding pipette rack for use in the laboratory.

In recent years, the use of pipettes and pipette tips has become widespread because of the requirements to maintain sterile or aseptic conditions while conducting various laboratory tests. This usage occurs both in the medical testing laboratory, wherein fluid samples taken from human beings are tested in various laboratory procedures, and extends to the biomedical and bioengineering laboratories where research is done in advanced areas of biology and the like.

The requirement to maintain an aseptic condition is paramount in that contamination of any sort in the biological laboratory can result in improper findings relating to the particular area being investigated. In the medical field, it is even more important as the tests performed may very well result in having a lasting impact on the patient upon which the tests were performed. In the last ten or fifteen years, the requirement for tests for HIV or Human Immunodeficiency Virus, has put even more severe pressure on medical testing laboratories. A false positive test, of course, results in severe hardship on the patient, while a false negative test would not only have impact on the patient, but could result in more widespread disease. From the laboratory technician's standpoint, contact with contaminated specimens that are being tested is, of course, of vital concern as the laboratory technician could suffer from the very disease that he or she is attempting to investigate should contamination become widespread.

Accordingly, laboratories have reached the point that laboratory equipment, particularly the interface of the equipment and the sample, is simply not handled by a human being after sterilization.

Pipettes and pipette tips are used, of course, and have been used for a number of years, to obtain small, measured samples of whatever is to be tested. Until about 20 years ago, pipettes were a single entity made of glass, and were cleaned and sterilized after each use. About 20 years ago, the plastic pipette tip and a mechanical pipettor came on the market and rapidly achieved widespread use. The single pipettor used a pipette tip approximately 2 to 2½ inches long that is tapered in its form so that it would fit on a tapered end of the pipettor. The pipettor has a piston action that creates a suction within the pipette tip so that fluids can be drawn up into the pipettor. The advantage of the mechanical pipettor is that the plastic tip can be thrown away as that is the only area that the sample touched. Since great numbers of pipette tips are used, these pipette tips are usually sold in racks. Pipette tips racks appeared in the market concurrently with the pipette tips, but always presented a problem of how to load the pipette tips into the racks. While methods have been devised to load tips into the racks, the concern for the environment has caused a movement in the laboratories to reuse pipette tip racks which, in the past, were thrown away once they were empty. Accordingly, it has become the practice of the laboratories to buy racks loaded with pipette tips and as the racks are emptied, pipette tips sold in bulk are reloaded into the racks by hand.

The manual loading of pipette tips is tedious and time-consuming. Thus, in recent months, the manufacturers of pipette tips have attempted to utilize schemes for loading pipette tips into the trays for use in laboratories.

The requirement for a tray is present because the present pipettors are multiple-channel pipettors; that is, they mount either eight or twelve pipette tips at a time so that eight or twelve samples can be taken concurrently. The rack sits on the laboratory bench and the pipettor is forced down onto a row of pipette tips contained in the rack. The rack usually is formed with eight tips across and twelve tips lengthwise. A de facto standard among pipettor manufacturers dictates the spacing between the pipette tips and the rack.

The present reloading devices are cumbersome and appear to save only a small percentage of plastic in their attempt to resolve the reuse of pipette tip racks.

The present invention reduces the use of plastic considerably more than the existing racks so that the user can buy pipette tips loaded in a flat and then, by using a specially-designed device, load those stacked pipette tip flats into conventional racks for use on the laboratory bench.

It is an object of this invention to provide a loading device for pipette tips that will enable the user to load tips into conventional racks that are found in the marketplace.

It is another object of this invention to reduce the use of plastics in the manufacture of pipette tips and pipette tip racks.

It is still another object of this invention to provide a device that will load multiples of pipette tip flats into a series of pipette tip racks.

It is also an object of this invention to provide a specially configured rack and flat for use with the loader.

SUMMARY OF THE INVENTION

A pipette tip rack is disclosed having four side walls and an upper surface member affixed to the upper end of each of the side walls. The upper surface defines a plurality of holes in a regular pattern and is formed to receive and hold a conically shaped pipette. The upper surface member further includes at least two upstanding bosses, one boss positioned adjacent one end of said upper surface and the other boss positioned at a point remote from said first boss, and a flat, the flat having substantially the same shape as the upper surface member, said flat defining a plurality of holes each formed to receive and hold a conically-shaped pipette tip substantially in the same regular pattern as said upper surface member holes so that when said flat is positioned atop said upper surface member, at least some of said holes in said flat will register with at least some of said holes in said upper surface member, said flat also defining at least two register holes positioned in said flat in substantially the same relative location on said flat as said two upstanding bosses on said upper surface member so that when said flat is placed on said upper surface member and said two upstanding bosses pass through said at least two register holes, said holes in said flat register with said holes in said upper surface member.

BRIEF DESCRIPTION OF THE DRAWINGS

FIG. 11 is a front elevation view of the pipette tip rack of this invention shown in the accompanying special box;

FIG. 12 is a sectional view of the box shown in FIG. 11 along with a rack and a flat, the figure showing the inventive features of the box, rack and flat;

DETAILED DESCRIPTION OF THE PREFERRED EMBODIMENT

Figure 1:
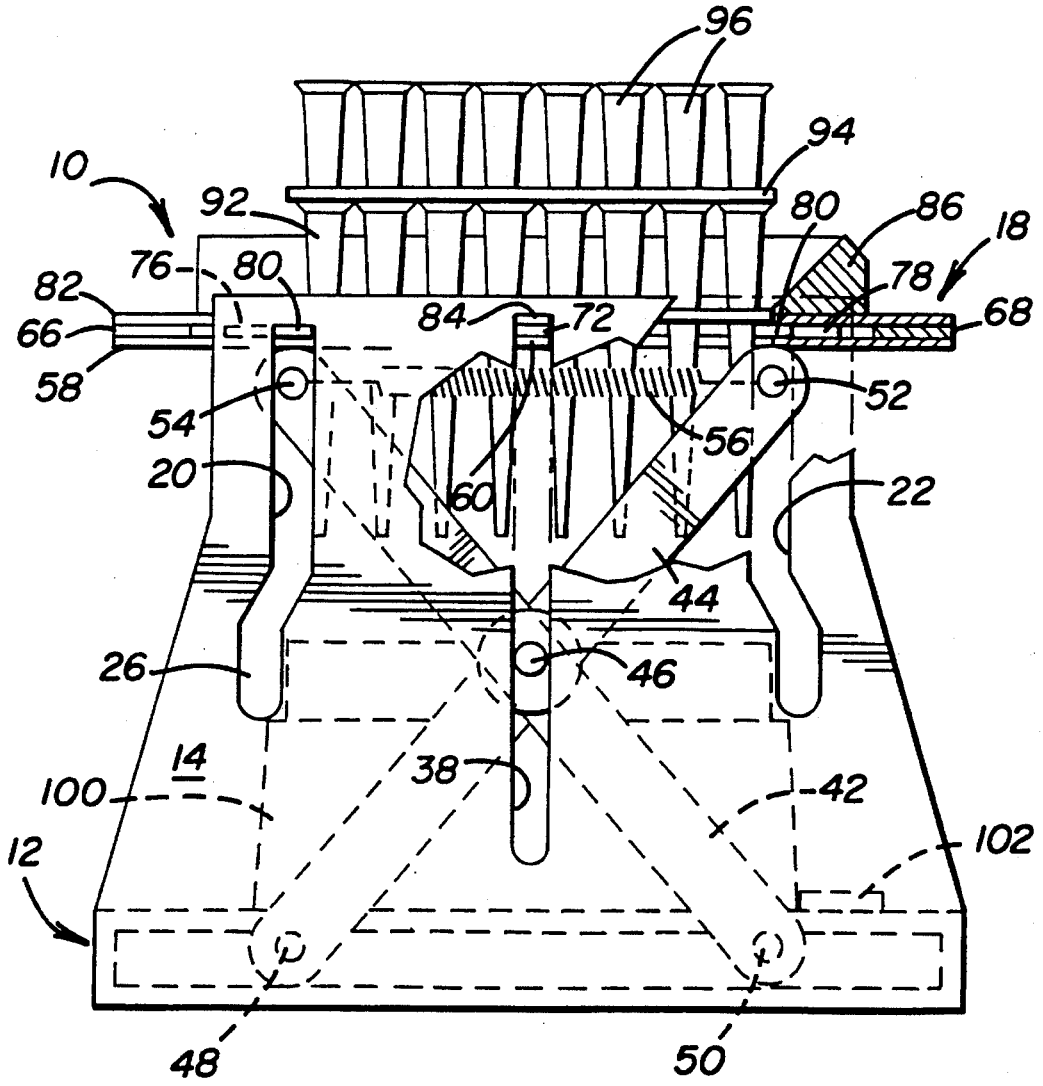
FIG. 1 is an end view of the pipette tip loading device described herein in its first position.
Figure 2:
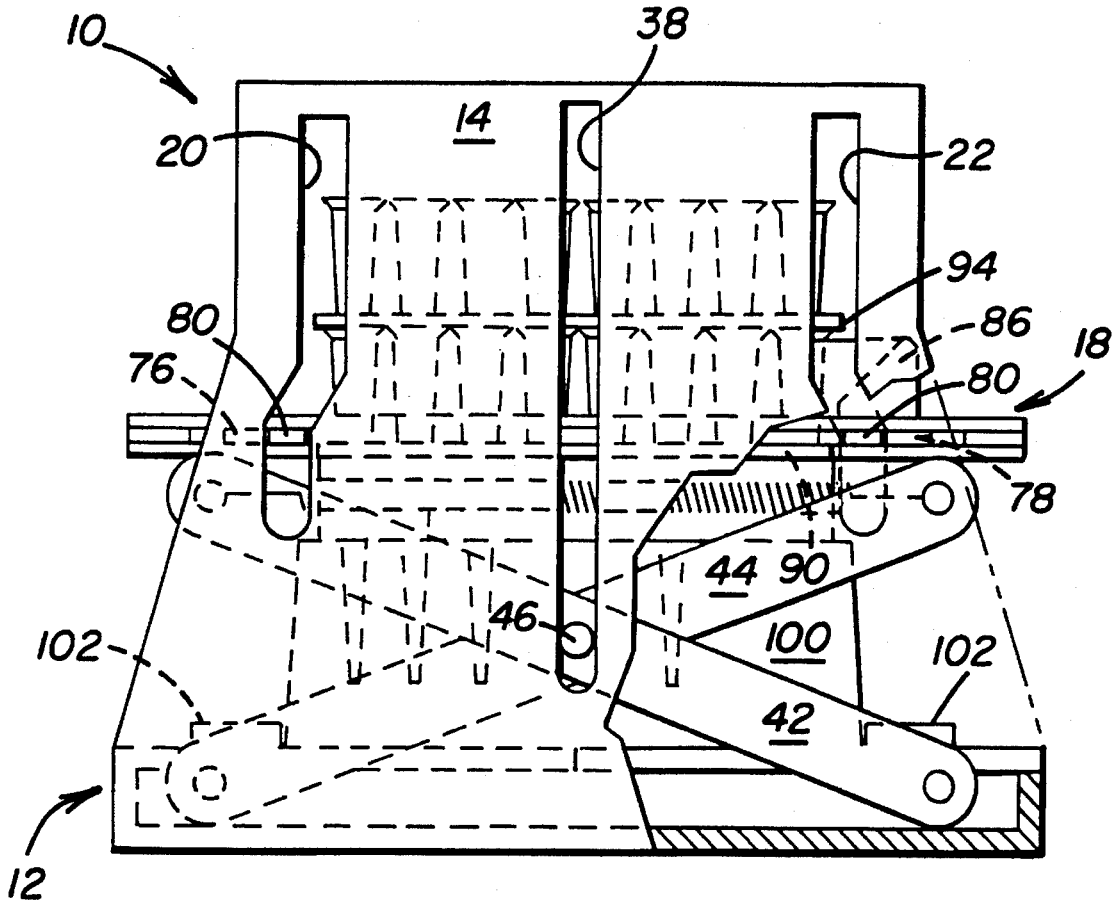
FIG. 2 is an end view of the same pipette tip loading device in its second position.

Referring now to FIG. 1, a pipette tip rack loading device 10 is shown. The pipette tip loading device 10 includes a rectangular base member 12. A pair of side plates 14 and 16 (see FIG. 3) are upstanding of the base member 12. A platform assembly 18 is movably associated with the side plates so that the platform assembly 18 can move from its first position as shown in FIG. 1 to its second position as shown in FIG. 2 in a parallel relationship to the base member 12. It should be noted that the platform assembly is also rectangular and substantially the same dimensions as the base member 12.

Figure 5:
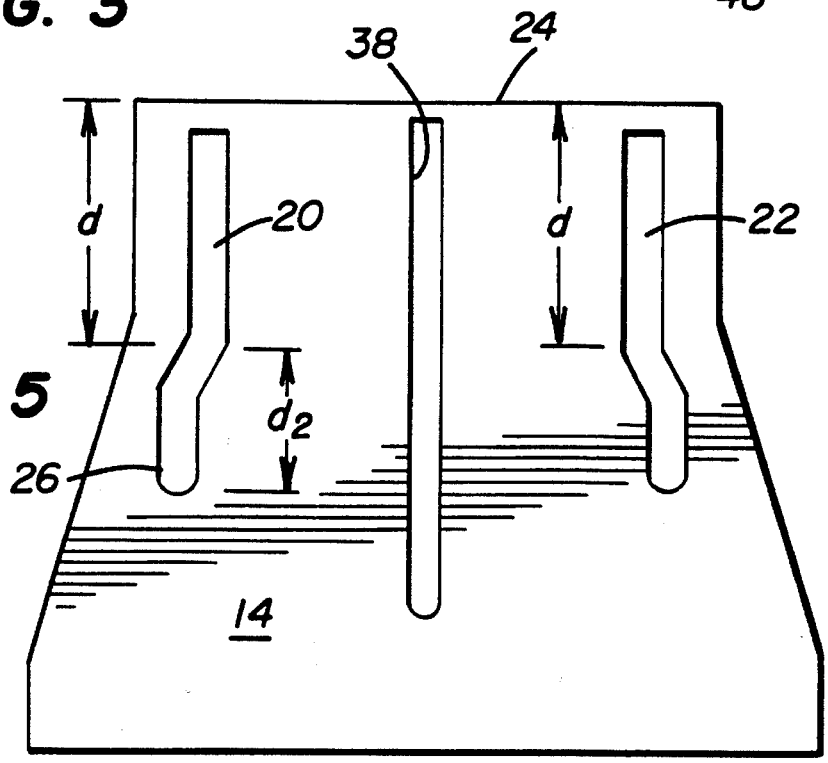
FIG. 5 is an elevation view of one of the side plates.

Referring to FIG. 5, an end view of one of the two side plates is depicted. The side plates have a pair of camming slots 20 and 22 extending downwardly from the upper edge 24 thereof. Each of the cam slots extends downwardly a predetermined distance d. They are separated by a second predetermined distance. As they approach the base member 10, they diverge outwardly for a second distance d2 so that they are separated by a distance greater than they were at the upper end 24 of the side plate 14. At the bottom of the groove, there is a short area 26 wherein the slot may extend again vertically downwardly toward the base 10. Interspersed between the two slots 20 and 22 is a third camming slot 38. The purpose of the cam slots 20 and 22, briefly stated, is to operate the release mechanism which will be described in relation to the upper platform. The purpose of cam slot 36 is to act as a guide for the parallel motion means also to be described. It is pointed out that the second side panel 16 is identical to the first side panel 14, with the camming slots in the same position.

Figure 6:
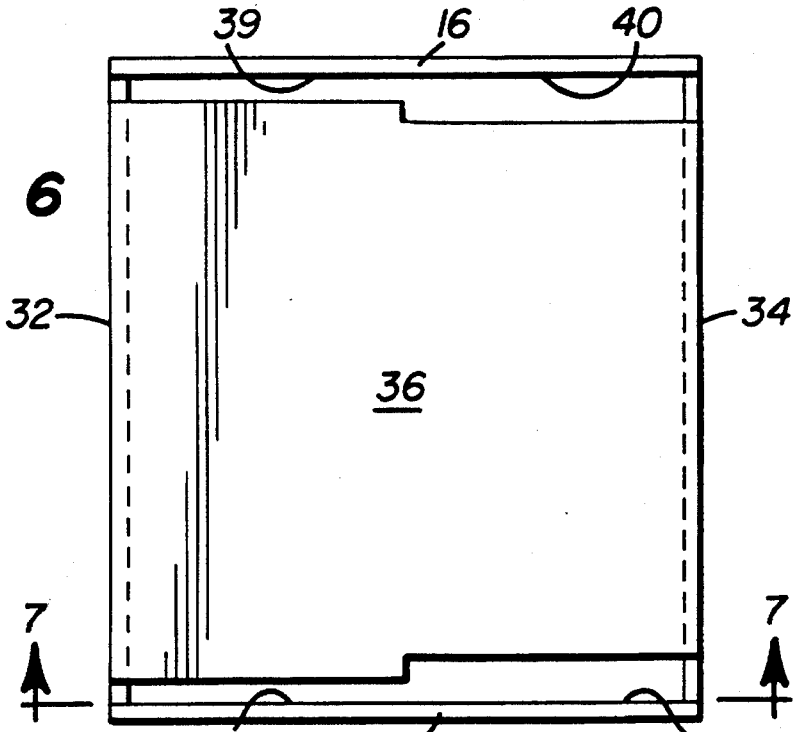
FIG. 6 is a plan view of the base assembly.
Figure 7:
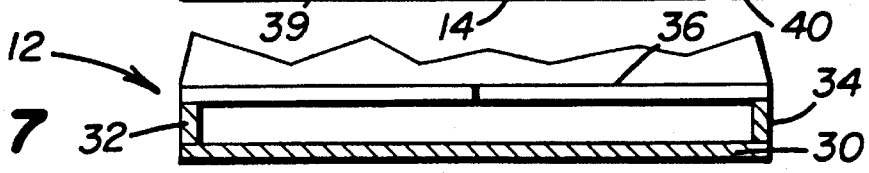
FIG. 7 is a sectional view of the base assembly shown in FIG. 6 taken at section line 7—7.

Referring now to FIGS. 6 and 7, the base member 12 is shown. Base member 12 consists of a lower base 30, shown in FIG. 7, two side members 32 and 34, also shown in FIG. 7, and an upper base platform 36, shown in FIG. 6. Upper base member 36 is not as wide as the lower base member 30 as evidenced in FIG. 6. This smaller dimension creates openings 39 and 40 between the side members 14 and 16. The openings 39 may be enlarged on one-half of the base member at 40, as shown in FIG. 6. The purpose of the openings 39 and 40 is to permit the parallel motion members 42 and 44 to extend downwardly into the slots 39 and 40.

Parallel motion members 42 and 44 are best seen in FIG. 1. They are identical in structure and form an X-type or scissors mechanism, as can be seen in FIG. 1. The two members 42 and 44 are pivotably affixed one to the other by an axle 46 so that they may have a scissors-type motion. Axle 46 extends outwardly into slot 38 when the device is assembled (see FIGS. 1 and 2).

At the lower end of the scissors members 42 and 44 are rods 48 and 50, which extend across underneath the upper base platform 36 to connect to the corresponding scissors members 42 and 44 at the opposite end of the rack, as shown in FIG. 1. The second set of scissors is identical to the first set. The upper end of scissors 42 and 44 are interconnected to the identical pair of scissors 42 and 44 on the opposite side of the rack by pin members 52 and 54. Stretched between pin members 52 and 54 is a resilient means, such as a spring 56, or an elastomeric member, thereby biasing the scissors device to the closed position, as shown in FIG. 1.

Figure 8:
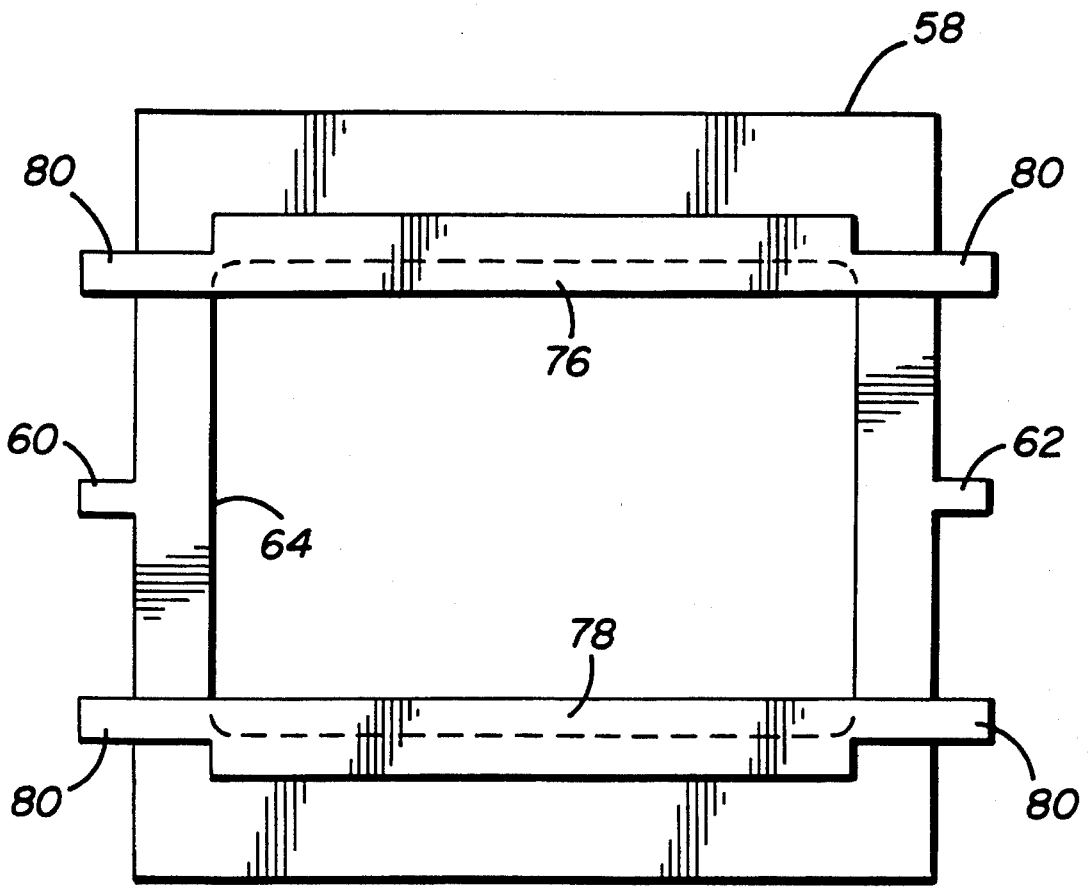
FIG. 8 is the lower member of the platform assembly and the slides.

The upper platform assembly 18 consists of two members affixed one to the other. A lower member 58 is shown in FIG. 8. The lower member 58 is rectangular in shape and has extending outwardly therefrom two bosses 60 and 62, which are adapted to ride in slots 38 on each of the two ends, 14 and 16. A rectangular opening 64 is centered on the lower piece 58. Opening 64 is sufficiently large to let a pipette tip flat (to be described) pass therethrough in a flat orientation.

Figure 9:
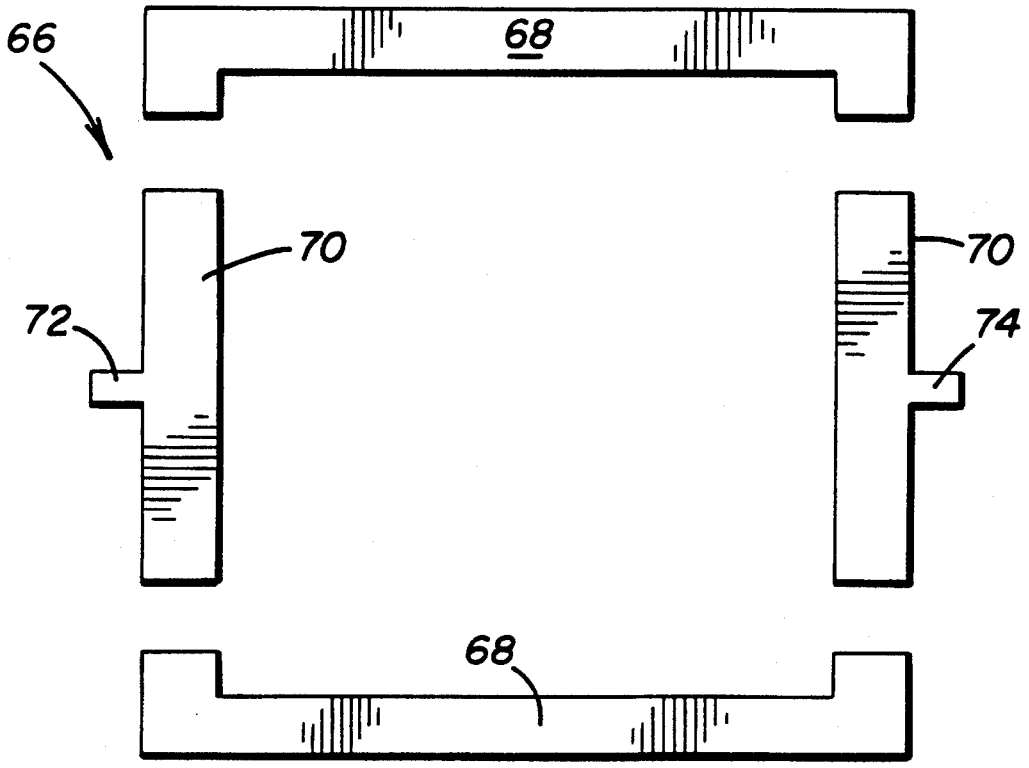
FIG. 9 is a section view of the lower member shown in FIG. 8 taken at section line 9—9.

Lower member 58 has two cut-out or depressed areas 79 shown in section in FIG. 9. These cut-outs 79 extend across the width of lower member 58 so that slides 76 and 78 may move laterally toward and away from opening 64. When the upper member 82 of platform 18 and the lower member are assembled, slides 76 and 78 are movably positioned as shown in FIG. 8.

With the slides 76 and 78 in their closed position, a pipette tip flat (to be described) will not pass through the opening 64. In their open position, that is, drawn laterally away from the opening 64, the pipette tip flat will pass through the opening 64. Fitted on either end of slides 76 and 78 are bosses 80, which in fact are cam followers for the cam slots 20 and 22.

Figure 10:
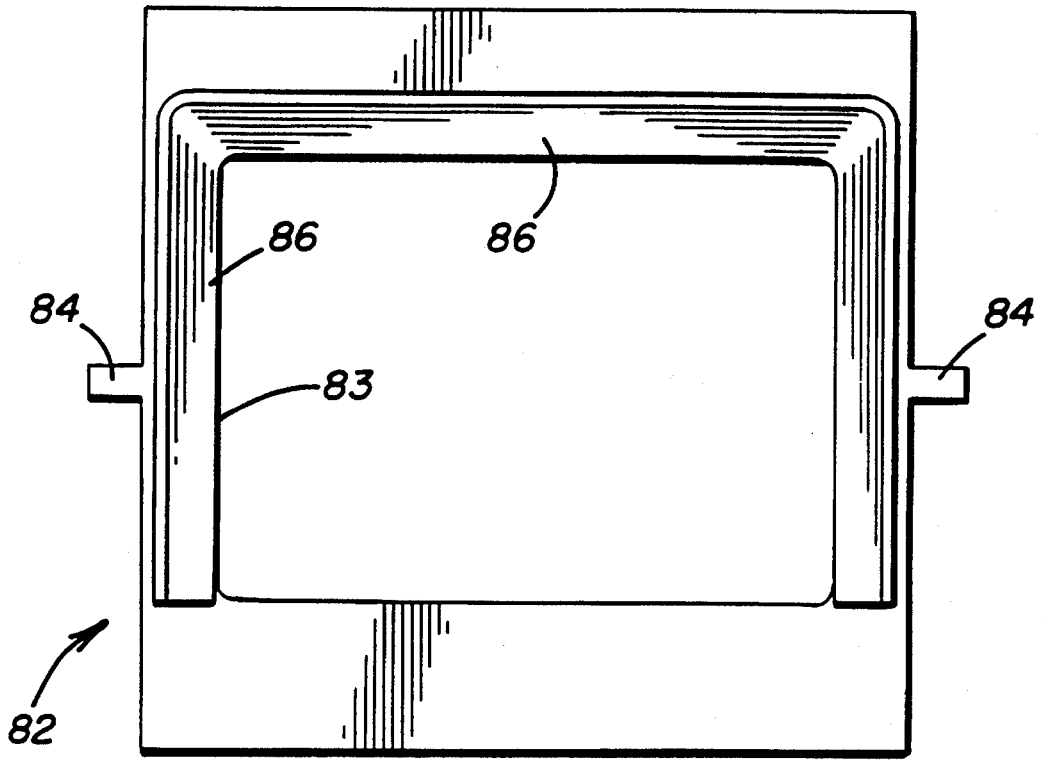
FIG. 10 is the upper member of the platform assembly.

The upper member of the platform 18 is a rectangular piece 82, as shown in FIG. 10. The upper member 82 corresponds to the lower member 58, with the exception that the opening in the upper surface thereof may be slightly smaller, but is at least as large as the pipette tip flat that is passed therethrough. Again, bosses 84 are located on the sides of the top platform 82 so that they register with the previously described bosses 60 and 62 located respectively on the lower platform. The opening in the upper platform 82 is beveled at 86 (see FIG. 10) to facilitate a flat passing through the opening.

When assembled, the platform assembly 18 may be prevented from separating from the rest of the assembly by the closures in the slots 20, 22, and 38, as shown in FIG. 5. The platform assembly 18 is prevented from moving upwardly beyond that point, but is biased upwardly by resilient member 56 and by the parallel motion action of the scissors 42 and 44.

Figure 3:
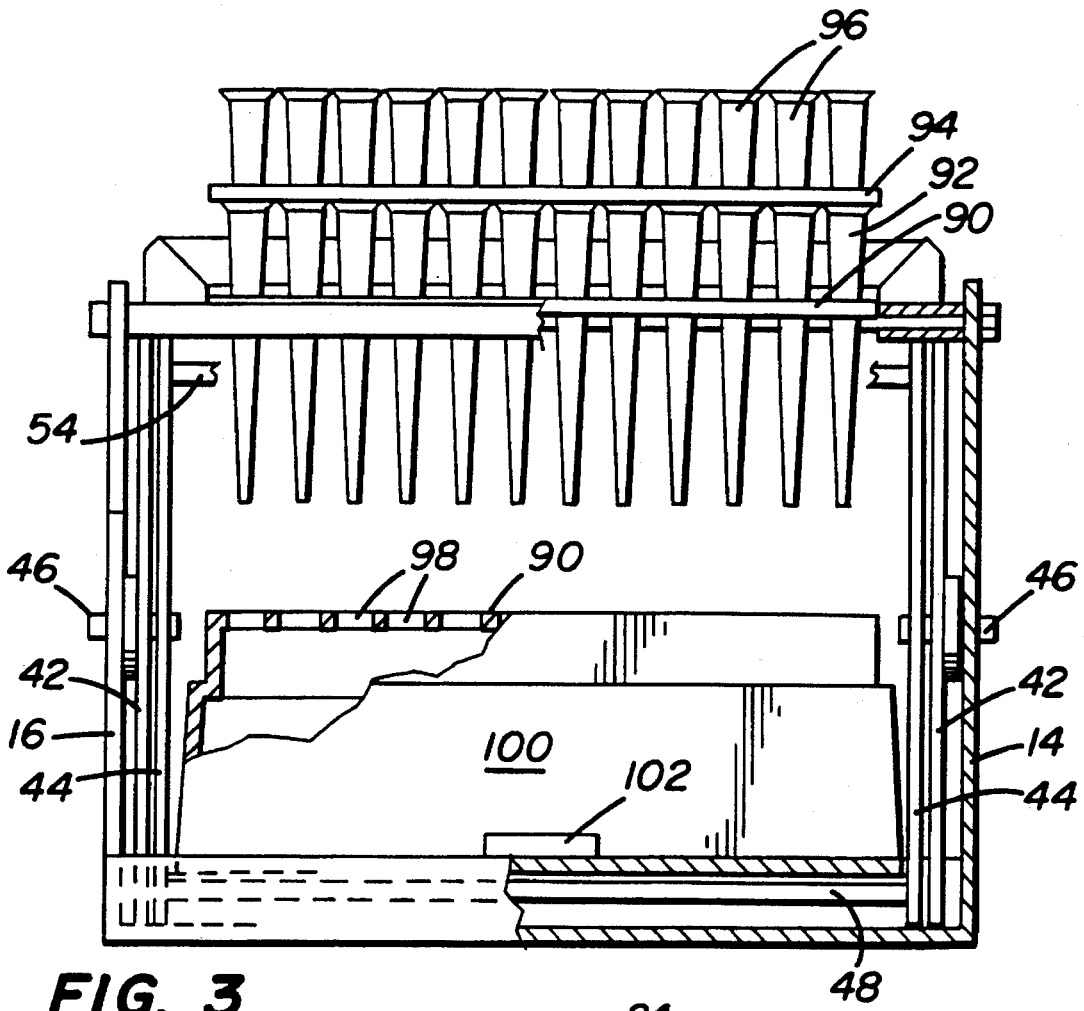
FIG. 3 is a side view of the pipette tip loading device shown in FIG. 1.
Figure 4:
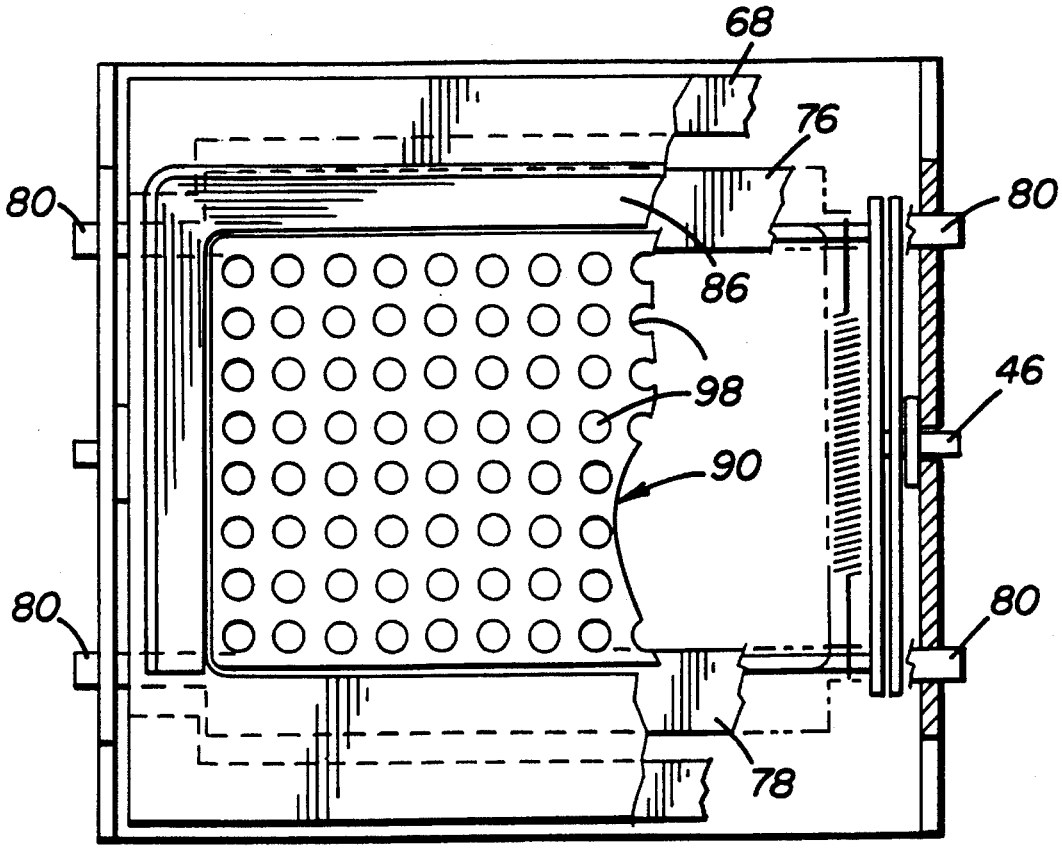
FIG. 4 is a top view of the pipette tip loading device shown in FIG. 1.

Referring to FIG. 4, an upper view of a pipette tip flat 90 is illustrated positioned in the tip loader 10. In the side view in FIG. 3, this same flat 90 is located in the rack with attendant pipette tips 92. A second flat 94 is shown for illustration purposes only, along with its plurality of pipette tips 96. The flats 90, best shown in FIG. 4, contain a plurality of holes 98 in a regular pattern, for example, eight rows of twelve holes each, in which pipette tips, such as pipette tips 92 and 96, may be positioned. These holes are carefully registered with a corresponding set of regular holes in a pipette tip rack 100, which is shown in FIG. 3. Pipette tip rack 100, as noted above, has an equal number of holes 97 in its upper surface 91, the holes 97 positioned in the same regular pattern so that the holes 97 in the rack 100 will register with the holes 98 in rack 90.

Flat 90 also includes two register holes 200 and 202 at opposite ends of flat 90. These two register holes are located at the same relative position to the holes 98 as two corresponding upstanding bosses 204 and 206 located on the upper surface of pipette tip rack 100 (see FIGS. 2 and 3). These register holes and upstanding bosses serve to hold flat 90 in register after it is positioned atop pipette tip rack 100.

Rack 100 must be positioned properly in loading device 10 so that when the device is operated, a flat 90 loaded with pipette tips 92 may be positioned on rack 100 with the pipette tips 92 meshing properly with rack 100. Accordingly, rack 100 includes an orifice or slot 208 (see FIG. 3) located near the top of one of the four upstanding sides of the rack. This slot 208 receives a tongue 210 that is rigidly mounted on a wall 102 that is affixed to and extends between sidewalls 14 and 16. Orifice or slot 208 is purposely made with its horizontal dimension only slightly larger than tongue 210 to effect horizontal registration. The rack 100 is prevented from being skewed in loader 10 as the tongue is affixed to a horizontal stop member 212 so that rack 100 may abut against the stop member when correctly positioned. The vertical dimension of slot 208 is sufficient so that rack 100 may be loaded while it is in a box 220 (see FIG. 11).

Box 220 has inside dimensions slightly larger than rack 100; that is, the inside length of box 100 is slightly longer than rack 100 and the inside width of box 100 is slightly wider than rack 100. This results in a snug fit when a rack is positioned in the box. Further, slot 208 will still register with tongue 210 just as stop member 212 will abut rack 100 and not box 220 with the rack 100 in loader 10 as the upper portion of the rack extends above the lip of the box.

Figure 13:
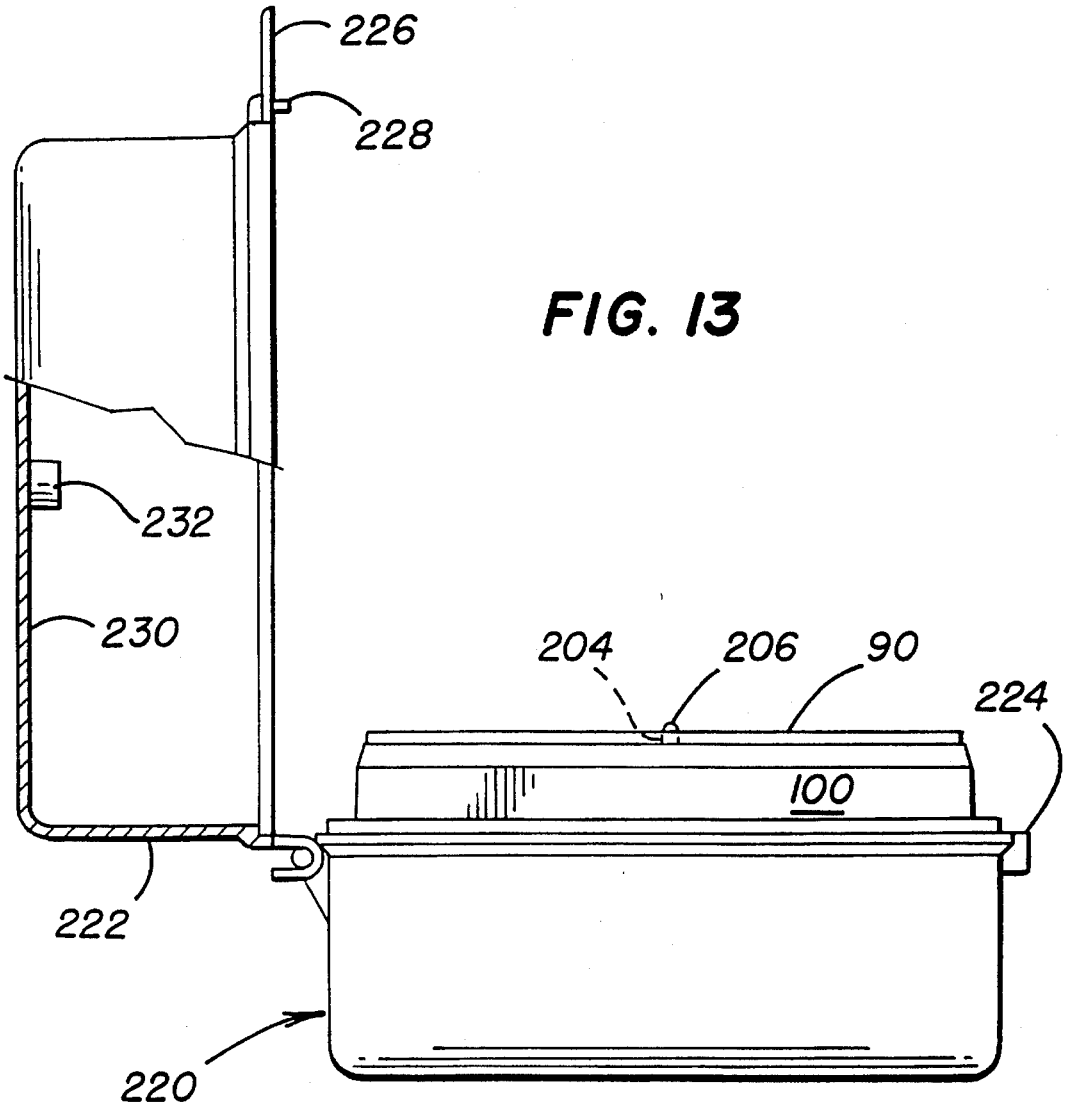
FIG. 13 is a side elevation view of the box, rack and flat.
Figure 14:
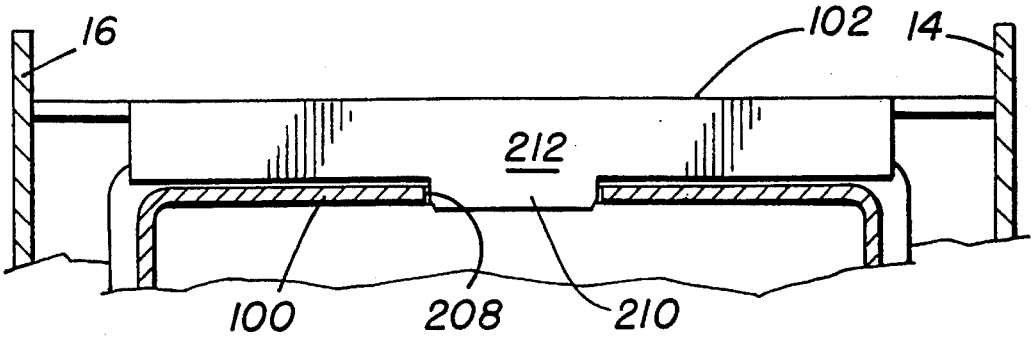
FIG. 14 is a section view taken at line 14—14 of FIG. 1.

Box 220 includes a cover 222 hingedly fixed to box 220 so that the cover may be removed (see FIG. 13) by fully opening the cover to its 180° position and then separating it from box 220. Also included is a latch device including a socket 224 on box 220 and a latching member 226 that folds over socket 224 when pin 228 seats in socket 224 to lock the cover on box 220.

Located on the inner surface 230 of the top of cover 222 are at least two lugs 232 which extend downwardly when cover 222 is closed so that each lug 232 will contact at least one and preferably two pipette tips in rack 100 and flat 90 to insure that flat 90 is registered with rack 100 by means of at least pins 204 and 206 registering with holes 200 and 202 (see FIG. 12).

In operation, a flat 90 or a plurality of flats 90, 94 (see FIG. 3) are placed in the opening in the upper platform 18. At this point, they are resting on the two slides 78 and 76 (see also FIG. 8) and will not pass through the opening in the lower portion of the upper platform. Further, the bevel 86 in the upper member of platform 18 insures that the holes 98 in the flat 90 are registered with a rack 100. Rack 100 is similarly held in a predetermined position by tongue 210. The top platform 18 is depressed manually so that the parallel motion arms 42 and 44 separate, as best illustrated in FIG. 2. As the cams 80 pass down the camming slots 20 and 22, they separate and withdraw the slides 76 and 78 so that the pipette tips 90 register with the holes in the pipette tip rack 100. As the structure reaches its lowest position, as shown in FIG. 2, the slides 78 and 76 fully open and the flat 90 is released to rest upon the pipette tip rack 100, which is shown in phantom in FIGS. 1 and 2. Concurrently, the registration pins 204 and 206 penetrate holes 200 and 202 to hold the flat in position. If the rack is in a box 220 when loaded, lugs 232 will insure the flat remains in rack 100 in the proper position when cover 222 is closed.

At this point, the second flat 94, as can be seen in FIG. 2, is above the diverging portions of the camming slots 20 and 22, so that as the platform assembly 18 is urged upwardly by the resilient member 52, bringing together the scissors 42 and 44, the slides 76 and 78 are cammed inwardly by those slots 20 and 22 to pick up the next pipette tip flat 94 as the assembly expands into its upper position, shown in FIG. 1. At that point, the pipette tip rack 100 may be withdrawn from the device as the tip ends in the next flat 94 do not extend downwardly far enough to rest in the flat just positioned on the top of rack 100. It should be noted that if the rack 100 is in a box 120 when loaded, the cover of the box 220 will be opposite the tongue 210 or the cover may be removed.

The technician may then take rack 100 off to a workspace to utilize the tips placed therein in the assembly.

Once the tips are exhausted in rack 100, the flat 90 can be placed in a salvage bin while the rack 100 is returned to the device 10 to have a second or another set of pipette tips and associated flat inserted therein.

The advantage of this assembly is that the pipette tip rack may be used over and over again, while the only thing returnable to the manufacturer are the flats 90 and, if desired, the used pipette tips 92 and 96. This saves the manufacturer in that the pipette tip racks need not be manufactured equal to the pipette tips, but rather a flat is manufactured containing the requisite number of pipette tips. The user is saved the chore of placing pipette tips 90 into the rack 100 by hand, which has been the practice in the past. Further, rather than sending back pipette tip racks, which some pipette tip users had been doing, the pipette tip racks may be recycled right in the laboratory.

This invention is limited only by the appended claims which follow.

It is claimed:

1. A pipette holding assembly for holding a plurality of pipette tips, comprising:

a rack having four side walls, each side wall having an upper end and an upper surface member affixed to the upper end of each of the side walls, the upper surface member defining a plurality of holes in a regular pattern and formed to receive and hold conically-shaped pipette tips, said upper surface member further including at least two upstanding bosses, one boss positioned adjacent one end of said upper surface member and the other boss positioned at a point remote from said first boss;

further wherein said rack has a length l and a width w;

a flat, said flat having substantially the same shape as the upper surface member, said flat defining a plurality of holes each formed to receive and hold a conically-shaped pipette tip substantially in the same regular pattern as said upper surface member holes so that when said flat is positioned atop said upper surface member, at least some of said holes in said flat will register with at least some of said holes in said upper surface member, said flat also defining at least two register holes positioned in said flat in substantially the same relative location on said flat as said two upstanding bosses on said upper surface member so that when said flat is placed on said upper surface member and said two upstanding bosses pass through said at least two register holes, said holes in said flat register with said holes in said upper surface member; and, a box having a hinged cover, said hinged cover having a flat top, said box having an inside length greater than l and an inside width greater than w, said box having in an inside height with said hinged cover in a closed position greater than the height of said rack with said flat atop said rack and with a pipette tip held in said rack and flat, said flat top of said hinged cover defining at least two lugs formed on the inside of said flat top with said hinged cover and extending downwardly so that each of said lugs would come in contact of at least one pipette tip held in said flat and rack while said cover is closed, whereby said holes in said flat remain in register with said holes in said upper member.

2. The assembly of claim 1 wherein said hinged cover is removable from said box.

3. The assembly of claim 1 wherein said rack defines an orifice along one side thereof and adjacent to the upper surface member, said orifice for registering said rack in a device adapted for loading pipette tips positioned in said flat on said rack.

4. The assembly of claim 2 wherein said hinged cover includes latch means to temporarily lock said cover to said box.

5. A pipette tip holding assembly for use in a pipette loading device, the holding assembly comprising:

a rack having four side walls, each side wall having an upper end and an upper surface member affixed to the upper end of each of the side walls, the upper surface member defining a plurality of holes in a regular pattern and formed to receive and hold conically-shaped pipette tips, said upper surface member further including at least two upstanding bosses, one boss positioned adjacent one end of said upper surface member and the other boss positioned at a point remote from said first boss;

a flat, said flat having substantially the same shape as the upper surface member, said flat defining a plurality of holes each formed to receive and hold a conically-shaped pipette tip substantially in the same regular pattern as said upper surface member holes so that when said flat is positioned atop said upper surface member, at least some of said holes in said flat will register with at least some of said holes in said upper surface member, said flat also defining at least two register holes positioned in said flat in substantially the same relative location on said flat as said two upstanding bosses on said upper surface member so that when said flat is placed on said upper surface member and said two upstanding bosses pass through said at least two register holes, said holes in said flat register with said holes in said upper surface member;

said rack defining an orifice along one side thereof and adjacent to the upper surface member, said orifice for registering said rack in a device adapted for loading pipette tips positioned in said flat on said rack;

further wherein said racks have a length of l and a width of w;

a box having a hinged cover, said hinged cover having a flat top, said box having an inside length greater than l and an inside width greater than w, said box having an inside height with said hinged cover in a closed position greater than the height of said rack with said flat atop said rack and with pipette tips held in said rack and flat;

said flat top of said hinged cover defining at least two lugs formed on the inside of said flat top of said hinged cover and extending downwardly so that each of said lugs would come in contact with at least one pipette tip held in said flat and rack while said cover is closed, so said upstanding bosses on said rack are made to pass through said register holes in said flat, whereby said holes in said flat remain in register with said holes in said upper member.

* * * * *